US006289614B1

(12) United States Patent
Roselle et al.

(10) Patent No.: US 6,289,614 B1
(45) Date of Patent: Sep. 18, 2001

(54) STABILIZING SYSTEM FOR DIRT BUCKETS

(76) Inventors: Raymond Anton Roselle, 9109 Aboudara Ct., Bksfld., CA (US) 93311; Matthew Bruce Revenaugh, 8829 District Blvd.; Terry Lynn Houchin, 9201 Aboudara Ct., both of Bakersfield, CA (US) 93311

( * ) Notice: Subject to any disclaimer, the term of this patent is extended or adjusted under 35 U.S.C. 154(b) by 0 days.

(21) Appl. No.: 09/453,290

(22) Filed: Dec. 3, 1999

(51) Int. Cl.[7] ..... E02F 3/65
(52) U.S. Cl. ..... 37/417; 37/430
(58) Field of Search ..... 37/411, 414, 416, 37/417, 428, 430; 172/684.5, 799.5, 80, 77

(56) References Cited

U.S. PATENT DOCUMENTS 3,269,039 * 8/1966 Bodine ..... 37/126
3,486,254 * 12/1969 Campbell ..... 37/129
4,009,530 * 3/1977 Eftefield ..... 37/126
4,308,677 * 1/1982 Behm ..... 37/126
4,389,800 6/1983 Goby .
5,074,061 * 12/1991 Thompson ..... 37/129
5,307,570 5/1994 Brown .
6,041,528 * 3/2000 Broach ..... 37/431

* cited by examiner

*Primary Examiner*—Thomas B. Will
*Assistant Examiner*—Kristine M. Markovich
(74) *Attorney, Agent, or Firm*—James M. Duncan

(57) ABSTRACT

A stabilizing system for installation on existing dirt buckets which is used by engaging the ground surface being leveled with shock absorbing sleds affixed to the underside of the dirt bucket. The load characteristics of each shock absorber may be independently adjusted by hydraulic valving connected to each shock absorber. The minimum shock absorber pressure is set by inputting an inert gas into a connected fluid reservoir until the desired minimum pressure is reached. The maximum pressure is adjusted by the relief setting of a connected pressure control valve.

20 Claims, 7 Drawing Sheets

STABILIZING SYSTEM FOR DIRT BUCKETS

BACKGROUND

The present invention is directed toward improving the performance of towable land leveling scrapers, known as "dirt buckets" or "scrapers" , by stabilizing the dirt bucket so as to prevent "bounce," "waddle," or "duck walking" thereby increasing operational speed and preventing wear and tear on the dirt bucket.

The dirt bucket is a device used for dirt removal and ground leveling to prepare a parcel of land for construction or agricultural purposes, although it may also be used for excavating wide trenches and sumps. During the process of ground leveling, a cutting blade located at the bottom of the dirt bucket scrapes dirt from the ground surface which is collected in the bucket portion of the device. The elevation of the cutting blade with respect to the ground surface is adjusted by the operator by raising or lowering the wheels located at the rear of the dirt bucket. Dirt buckets are frequently run in tandem, where a second dirt bucket is towed directly behind first dirt bucket, which in turn is towed by a towing vehicle. Many dirt buckets implement laser surveying systems to achieve precise leveling of the ground surface.

While performing land leveling operations and during transportation dirt buckets have been known to bounce, undulate from side-to-side, waddle and duck walk. These undesirable motions are particularly severe as the dirt bucket travels at higher speeds, causing the cutting blade to dig unevenly into the ground surface, and requiring additional leveling work to obtain a satisfactory ground surface. These undesirable motions also cause wear and tear on the components of the dirt bucket because of additional vibration and cyclical loading. When these motions occur, a dirt bucket operator must slow the machine substantially to achieve the precise leveling of the ground surface which is achievable through the use of a laser surveying system and to prevent wear and tear on the dirt bucket otherwise caused by these undesirable motions.

Different solutions have been proposed to prevent or minimize undesirable motions in dirt buckets. U.S. Pat. No. 4,389,800 discloses a land leveling scraper which includes a skid shoe system where the bottom surface of the skid shoes accommodate and follow irregularities in the ground surface being leveled, and the skid shoes are urged against the ground surface with a force proportional to the load on the bucket of the scraper. Ideally, the skid shoes automatically adjust to irregularities on the ground surface and maintain maximum contact with the ground surface because the load on the skid shoes increases as the load on the bucket increases. However, the skid shoe system disclosed in U.S. Pat. No. 4,389,800 is an integral part of the land leveling scraper as opposed to an easily installed after-market addition. Moreover, this system operates on the same hydraulics which lower and raise the bucket and thus is not independently adjustable by the operator to allow custom settings for different earth removal applications, such as digging a sump as opposed to obtaining precise leveling of the ground surface. Finally, because this system is connected to other dirt bucket hydraulics, it can be difficult to maintain.

Another attempted solution is to add additional axles and wheels to the back of the dirt bucket. However, this solution is expensive, requires additional maintenance, and prevents running dirt buckets in tandem because the additional axles and wheels on the front dirt bucket interfere with installing the towing mechanism required for connecting the rear dirt bucket.

U.S. Pat. No. 5,307,570 discloses the attachment of skid shoes to dirt buckets by spring-loaded legs. However, adjustment of the load-bearing capacity of the skid shoes requires changing of the coil compression spring. Even if the proper spring is available, the spring-loaded legs must be dismantled for installation of different springs.

For the foregoing reasons, there is a need for a stabilizing system for dirt buckets which may be readily installed to existing dirt buckets, which operates independently of the dirt bucket hydraulic system, allows tandem operation of dirt buckets, and allows for easy operator adjustment of the resisting force.

SUMMARY OF THE INVENTION

The present invention is directed to an apparatus which satisfies the needs identified above. The apparatus comprises an easily installed system for preventing undesirable motions in dirt buckets through the use of a combination gas and hydraulic system, independent of the bucket hydraulics, with operator-adjustable hydraulic shock absorbers, which are pivotally attached to a plurality of stabilizing sleds. The stabilizing sleds, two per dirt bucket in the preferred embodiment, are hingedly attached at the front end of each sled to the underside of the dirt bucket directly behind the cutting blade, and pivotally connected at the rear of each sled by a shock absorber, the top of which shock absorber is pivotally connected to the underside of the rear of the dirt bucket. During ground leveling operations, when the loading of the dirt bucket would otherwise have been partially or fully transferred from the wheels to the cutting blade and the bottom of the dirt bucket, loading is instead transferred to the cutting blade, the bottom of the dirt bucket and to the stabilizing sleds. Each stabilizing sled is free to rotate about the hinge connection at the front of the sled, but a resisting force is applied to the rear of each sled by the shock absorber. The amount of resistance of each shock absorber is adjusted by the operator by adjusting the relief setting of a pressure release valve.

The stabilizing system, consisting of four major components, is readily attachable to all conventional types of dirt buckets in a few hours with the major components adaptable for bolting on to the dirt bucket and minimal welding required. The first component, which may be mounted on the crossbeam at the rear of the dirt bucket with two "Z-shaped" mounting brackets, is a fluid tank which provides a reservoir for an inert gas, usually air, and hydraulic oil. In the preferred embodiment, the fluid tank has a capacity of approximately five gallons and is designed to operate at a pressure of approximately fifty pounds per square inch. A single fluid tank may be used for multiple sled-shock absorber assemblies. The second component, which is hydraulically connected to the fluid tank, is a valve manifold which, for each hydraulic shock absorber, comprises a needle valve, a relief valve, and a check valve. In the preferred embodiment, the needle valve, relief valve and check valve are fabricated as an integrated valve package, which incorporates two each of the needle valve, relief valve and check valve, and the required hydraulic connections, into a single housing, with connections for pressure gauges for monitoring the approximate pressure in each shock absorber. The valve package is so designed to allow independent operation of two stabilizing sleds from the single unit. The third component is a hydraulic piston-cylinder shock absorber, one end of which is pivotally connected to the dirt bucket and the other end of which is pivotally connected to the rear of a stabilizing sled. An inlet-outlet port on the shock absorber is hydraulically connected to the valve manifold. The fourth component is a stabilizing sled, the rear which is pivotally connected to the shock absorber, and the front which is hingedly connected to the underside of the dirt bucket at the cutting blade assembly. In the preferred embodiment, two sleds are installed on each dirt bucket, one on either side.

DETAILED DESCRIPTION OF THE PREFERRED EMBODIMENT

With reference to the drawings, like numbers will be used to describe like parts in FIGS. 1 through 7.

Figure 1:
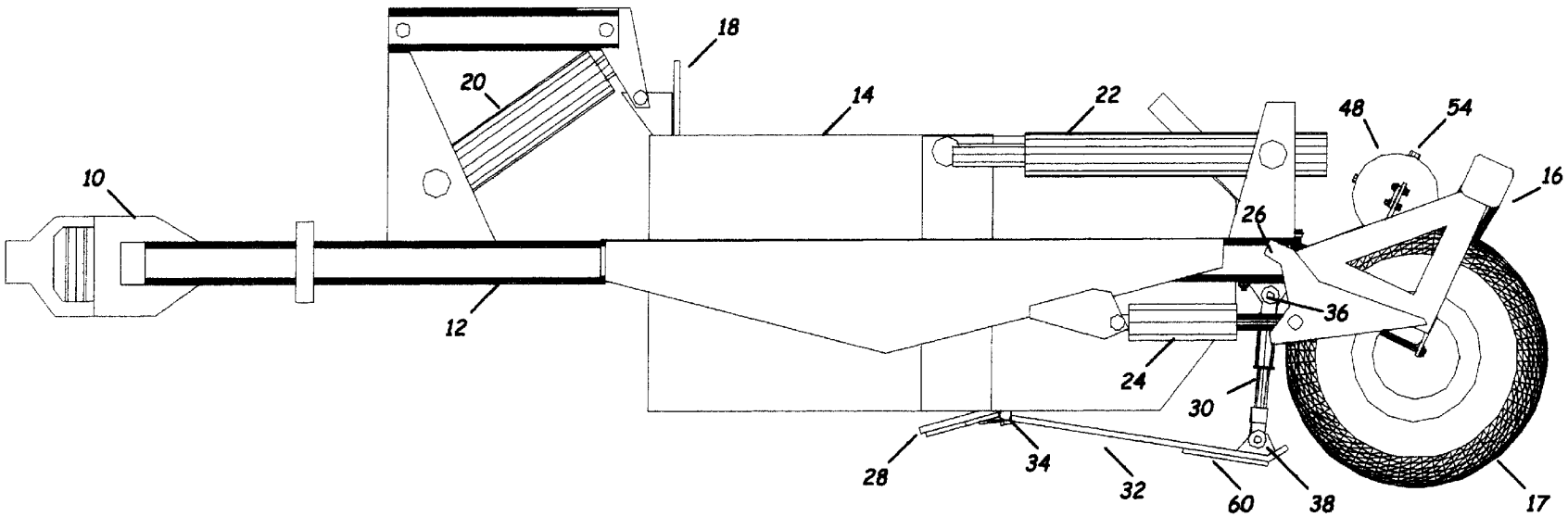
FIG. 1 is a side view of one variety of dirt bucket, showing the shock-absorber and sled components of the present invention, with the wheels of the dirt bucket lowered and the cutting blade raised in preparation for transporting the dirt bucket. Similar dirt buckets are depicted in U.S. Pat. Nos. 4,389,800 and 5,307,570, which are incorporated herein by reference.

FIG. 1 shows the major components of a typical dirt bucket, being the bucket frame 12 which is connected at its forward end to the towing assembly 10 for towing by a vehicle (not shown) and upon which frame the bucket assembly 14 is mounted and the wheel frame assembly 16 is connected at the rear. The dirt bucket is emptied by raising gate 18, which serves as the forward barricade to retain dirt within the bucket, by activating gate ram 20 and pivoting the bucket assembly forward by activating bucket rams 22, located on each side of the dirt bucket, thus raising the rear end of the bucket assembly 14 in a counter-clockwise motion with respect to FIG. 1.

Figure 2:
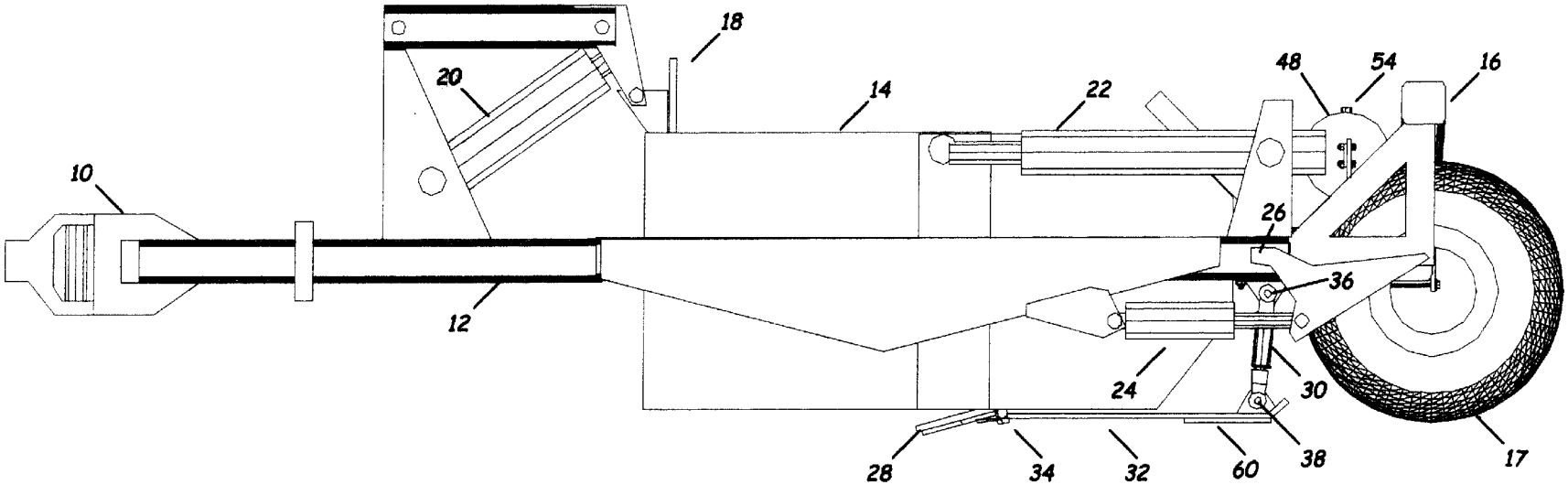
FIG. 2 is a side view of a dirt bucket, similar to FIG. 1, but showing the wheels of the dirt bucket raised and the cutting blade and and sled lowered and engaging the ground surface in preparation to commence ground leveling operations.

When the dirt bucket is conducting dirt removal operations, as illustrated in FIG. 2, the cutting blade assembly 28 is lowered to the ground surface by activating wheel rams 24, located on opposite sides of the dirt bucket, which are connected at the front end of the wheel ram to the bucket frame 12 and at the rear end of the wheel ram to the wheel frame assembly 16. The wheel frame assembly 16 is thus rotated on matching pivot pins 26, located on opposite sides of the dirt bucket, allowing the wheels 17 to be raised or lowered and thus causing the cutting blade assembly 28 to be, respectively, lowered or raised. As the wheels 17 are raised, sleds 32, affixed on each side of the dirt bucket, engage the ground surface, pivoting on respective hinge assemblies 34, one side of the hinge being affixed to the front of each sled and the other side of the hinge being affixed to the cutting blade assembly 28. As depicted on FIG.2 and FIG.3, the rear of each sled 32 is connected at the lower shock absorber mount 38 to a hydraulic shock absorber 30, which is affixed to the bottom of the cross-member 40 by the upper shock absorber mount 36. A wear plate 60 may be affixed to the bottom of each sled, as depicted in FIG. 4, by either welding or other fastening means.

As the sleds conform to undulations in the ground surface, hydraulic fluid contained within the hydraulic shock absorbers 30 is either compressed or expanded. Each hydraulic shock absorber 30 contains a port 58 which acts as either an outlet or inlet for hydraulic fluid, depending upon whether the shock absorber is being compressed or extended.

Figure 3:
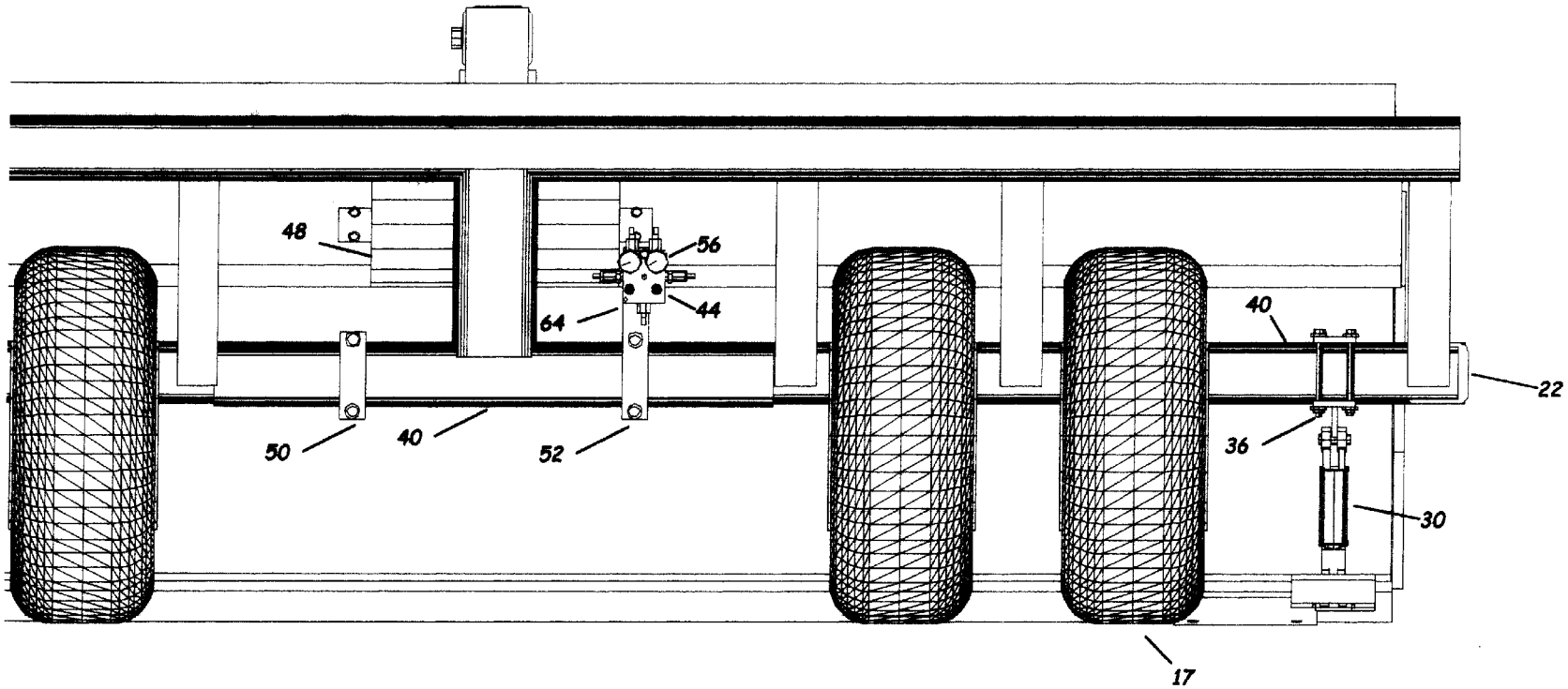
FIG. 3 is a rear view of a dirt bucket, similar to FIG. 1, showing one embodiment for mounting the fluid tank, valve manifold, shock absorber and sled components of the present invention.
Figure 4:
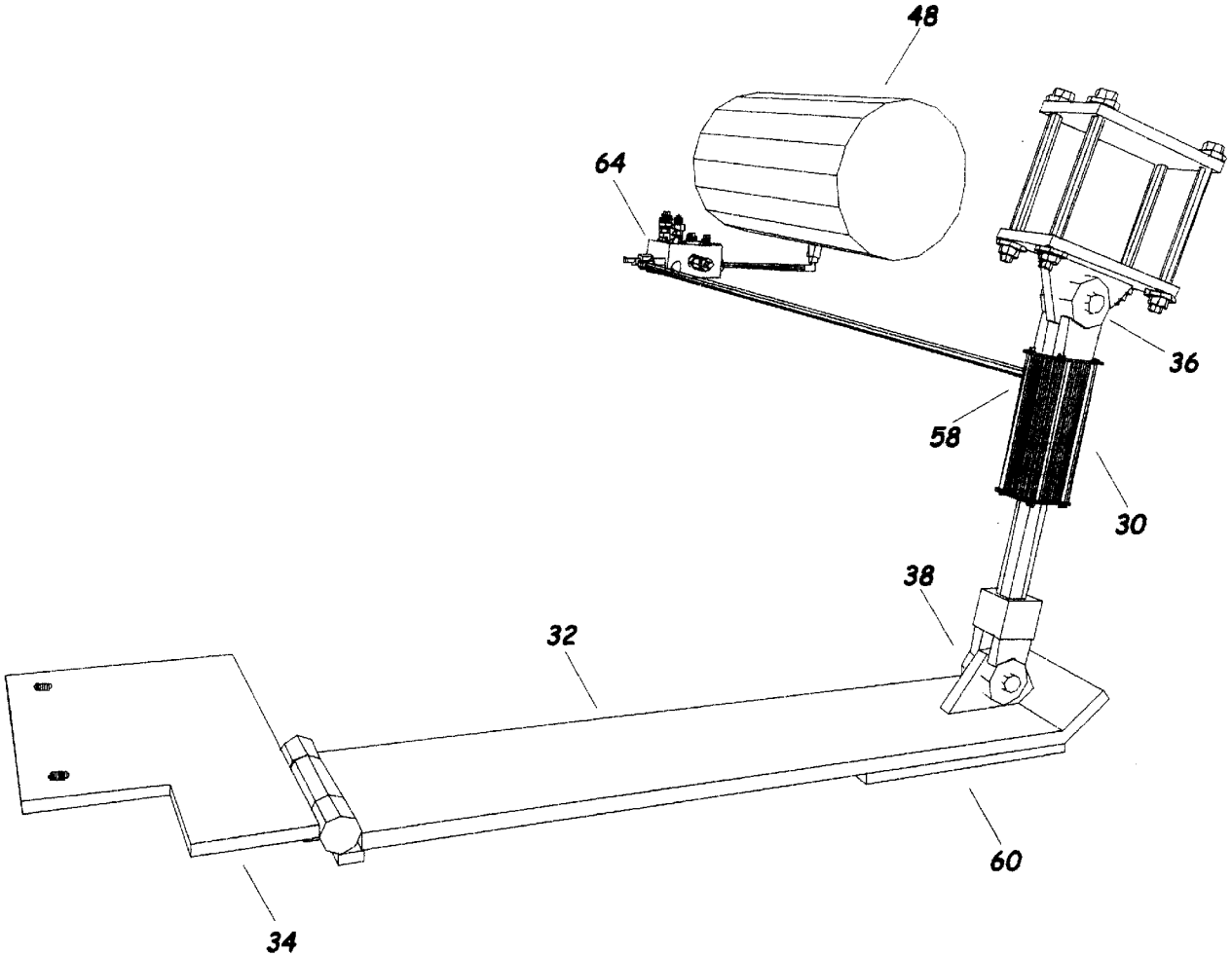
FIG. 4 is a diagrammatic illustration of the four separate components of the present invention, being the fluid tank, valve manifold, shock absorber, and sled.
Figure 5:
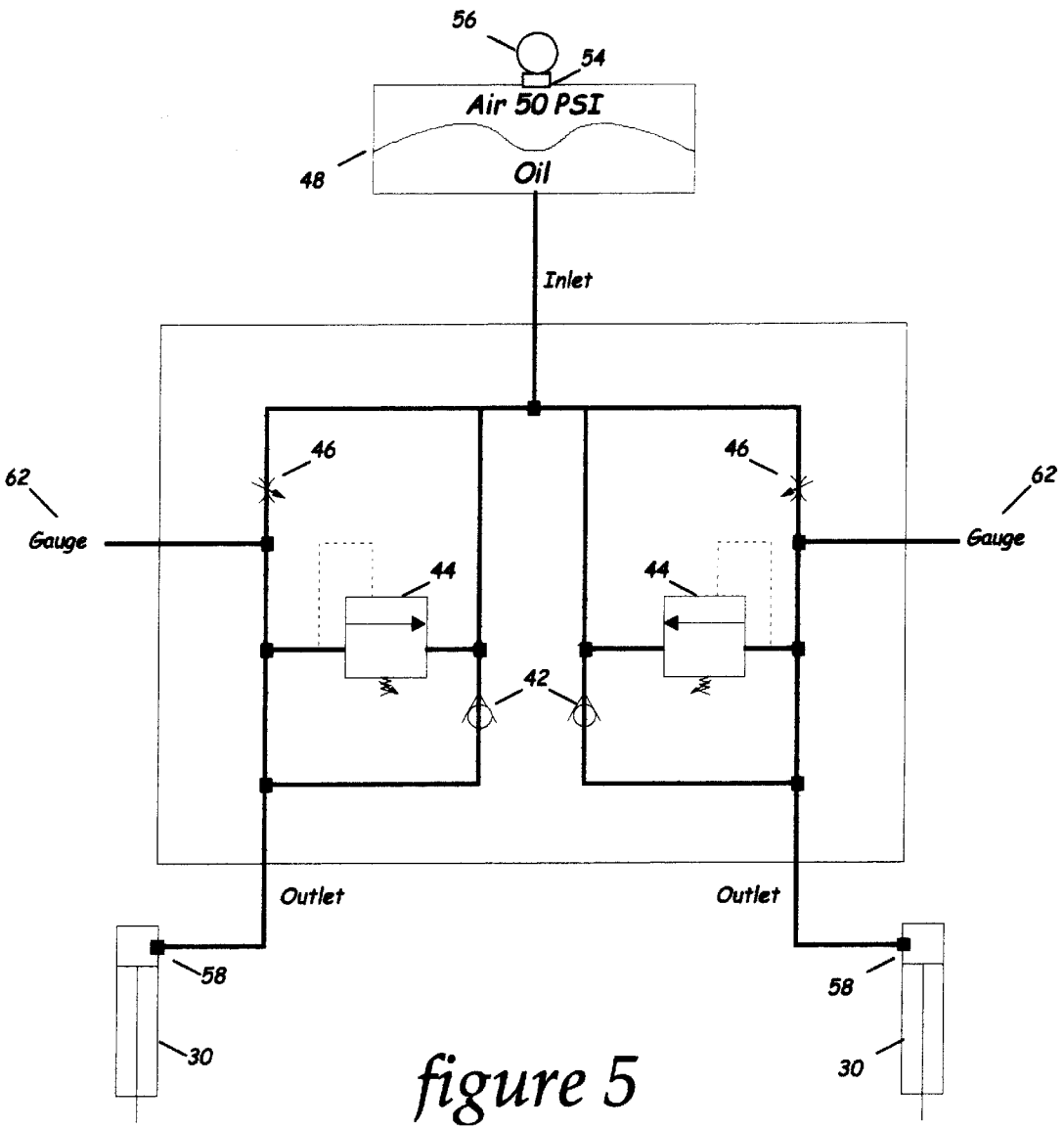
FIG. 5 is schematic of the gas and hydraulic system used for independently controlling the load resistance in two hydraulic shock absorbers.
Figure 6:
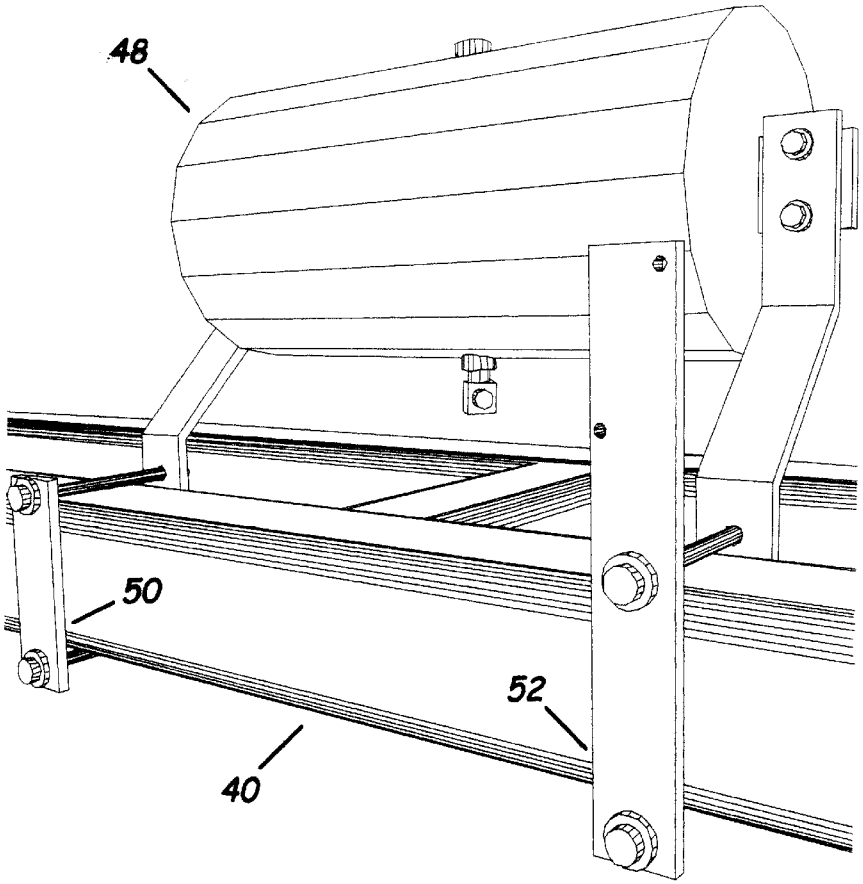
FIG. 6 depicts the mounting brackets for installing the fluid tank to a cross-member of the dirt bucket.

As depicted on FIG. 3, FIG. 4, and FIG. 6, hydraulic fluid for the hydraulic shock absorber 30 is stored within the fluid tank 48, which may be mounted on cross-member 40 with left-side mounting bracket 50 and right-side mounting bracket 52. Before initial operation of the stabilizing system, hydraulic fluid is introduced into the fluid tank 48 through an inlet valve 54, thus filling the entire system including the hydraulic shock absorbers 30, and the valve manifold assembly depicted on FIG. 5 with hydraulic fluid, until the tank is approximately half-full with hydraulic fluid. An inert gas, such as air, is then introduced into fluid tank 48 until the desired minimum operating pressure for the system is reached in the tank as detected by pressure gauge 56. This minimum operating pressure will be maintained in the hydraulic shock absorbers 30 so long as the sleds 32 do not engage the ground surface causing compression of the hydraulic fluid within the shock absorbers.

Figure 7:
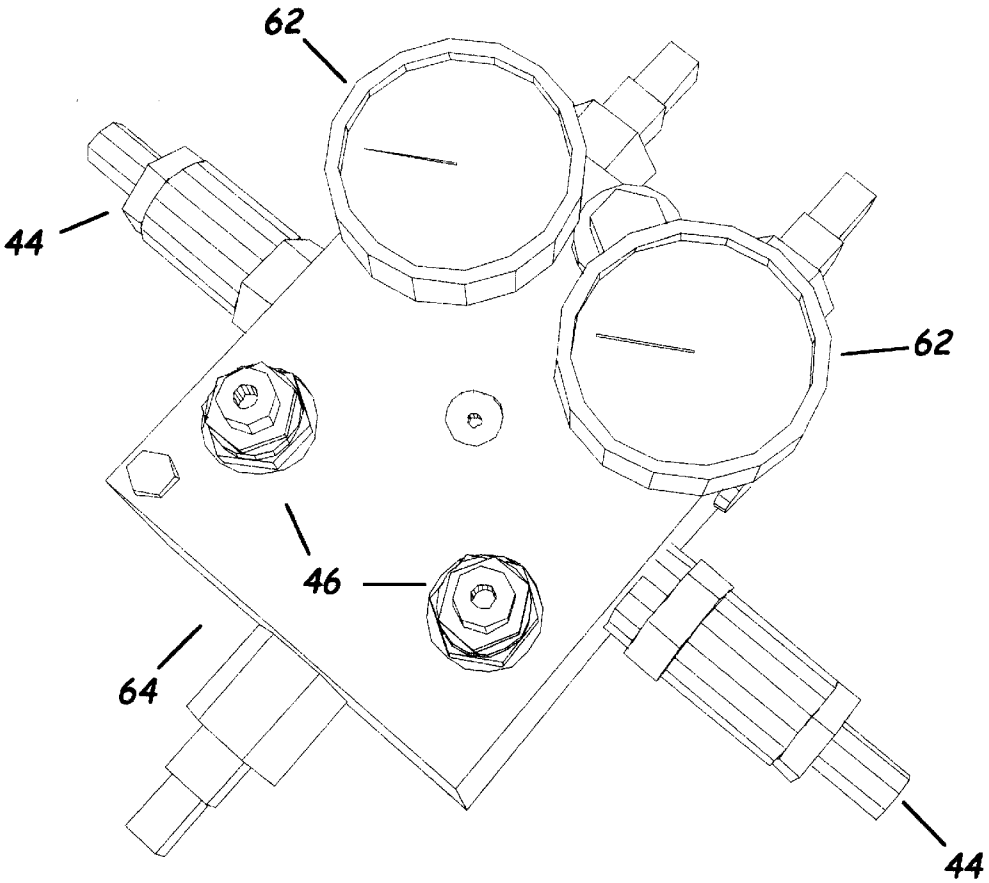
FIG. 7 depicts the integrated valve package utilized in the preferred embodiment, containing needle valves, pressure relief valves, check valves, and pressure gauges, mounted on the right side bracket used for mounting the fluid tank to a cross-member of the dirt bucket.

As the sleds 32 engage the ground surface, the shock absorbers 30 will be compressed, causing hydraulic fluid to be discharged from the shock absorbers into the valve manifold assembly depicted on FIG. 5 and FIG. 7. As depicted on FIG. 4 and FIG. 7, in the preferred embodiment, two check valves 42, two relief valves 44 and two needle valves 46 (the components of the valve manifold assembly) are fabricated as an integrated valve package 64 with a single housing, with the valves hydraulically connected to function as depicted in FIG. 5 to independently operate two hydraulic shock absorbers 30. While pressure within the valve manifold assembly increases as the shock absorbers 30 are compressed, needle valves 46 and check valves 42 act to isolate fluid tank 48 from the pressure increases and limit pressure within the tank to the minimum operating pressure. The relief setting of relief valve 44 is set at a preset maximum, which prevents pressure in the shock absorbers 30 and the valve manifold assembly from increasing above the relief pressure. Thus pressure in the shock absorbers 30, and the pressure acting against each sled 32, ranges from the minimum operating pressure to the relief pressure at which the relief valve 44 is set. The pressure of the hydraulic shock absorbers 30 is approximately displayed by pressure gauge 62.

While the above is a description of various embodiments of the present invention, further modifications may be employed without departing from the spirit and scope of the present invention. For example, the size, shape, number, location or orientation of the various components may be changed as desired, such as modifying the shape and size of the sled 32 for different field conditions. The functions of one element may be performed by two, and vice versa. For example, a separate fluid tank 48 may be used for each hydraulic shock absorber 30 rather than the single tank depicted in FIGS. 3 through 5.

Thus the scope of the invention should not be limited by the specific structures disclosed. Instead the true scope of the invention should be determined by the following claims.

What is claimed is:

1. A stabilizing system used in combination with a dirt bucket comprising:

(a) a sled for engaging the ground surface, the front of the sled hingedly attached by a front hinge assembly to the underside of the dirt bucket;

(b) a hydraulic shock absorber comprising a piston end and cylinder end, adapted to be pivotally attached on said piston end to the top surface of the sled back of said front hinge assembly and adapted to be pivotally attached on said cylinder end to the underside of the dirt bucket, said cylinder end possessing an inlet/outlet port for the flow of hydraulic fluid;

(c) a pressure relief valve hydraulically connected to said inlet/outlet port, such that the maximum pressure in the shock absorber is controlled by the relief setting of the pressure relief valve; and (d) a fluid tank hydraulically connected to said pressure relief valve and to said inlet/outlet port of the shock absorber, said fluid tank providing a reservoir for hydraulic oil, and containing valve means such that a minimum operating pressure may be set by introducing hydraulic fluid and inert gas into said fluid tank.

2. The stabilizing system according to claim 1 wherein the fluid tank is mounted to a rear cross-member of the dirt bucket by a right-side mounting bracket and a left-side mounting bracket.

3. The stabilizing system according to claim 1 wherein a wear plate is affixed to the bottom surface of said sled for making contact with the ground surface.

4. The stabilizing system according to claim 1 wherein the fluid tank has a volume of approximately five gallons.

5. The stabilizing system according to claim 1 wherein the fluid tank is equipped with a pop-off valve set to relieve pressure from the fluid tank, said tank being rated for an operating pressure of approximately fifty pounds per square inch.

6. The stabilizing system according to claim 5 wherein the hydraulic shock absorber, pressure relief valve and interconnecting hydraulic conduit are each rated for operating pressures in excess of one thousand five hundred pounds per square inch.

7. A stabilizing system used in combination with a dirt bucket comprising:

(a) a sled for engaging the ground surface, the front of the sled hingedly attached by a front hinge assembly to the underside of the dirt bucket;

(b) a hydraulic shock absorber comprising a piston end and cylinder end, adapted to be pivotally attached on said piston end to the top surface of the sled back of said front hinge assembly and adapted to be pivotally attached on said cylinder end to the underside of the dirt bucket, said cylinder end possessing an inlet/outlet port for the flow of hydraulic fluid;

(c) a valve manifold comprising a pressure relief valve, a needle valve and a check valve, each valve interconnected with hydraulic conduit;

(d) a fluid tank providing a reservoir for hydraulic oil, and containing valve means such that a minimum operating pressure may set by introducing hydraulic fluid and inert gas into said fluid tank; and (e) said valve manifold hydraulically connected between said fluid tank and said inlet/outlet port of the shock absorber such that the needle valve and the check valve limit flow of hydraulic fluid from said hydraulic shock absorber to the fluid tank, said pressure relief valve connected such that the maximum pressure in the shock absorber is controlled by the relief setting of the pressure relief valve and a minimum operating pressure is set by introducing an inert gas into said fluid tank.

8. The stabilizing system according to claim 7 wherein the fluid tank is mounted to a rear cross-member of the dirt bucket by a right-side mounting bracket and a left-side mounting bracket.

9. The stabilizing system according to claim 7 wherein a wear plate is affixed to the bottom surface of said sled for making contact with the ground surface.

10. The stabilizing system according to claim 7 wherein the fluid tank has a volume of approximately five gallons.

11. The stabilizing system according to claim 7 wherein the fluid tank is equipped with a pop-off valve set to relieve pressure from the fluid tank, said tank being rated for an operating pressure of approximately fifty pounds per square inch.

12. The stabilizing system according to claim 11 wherein the hydraulic shock absorber, pressure relief valve, needle valve, check valve, and interconnecting hydraulic conduit are each rated for operating pressures in excess of one thousand five hundred pounds per square inch.

13. A stabilizing system used in combination with a dirt bucket comprising:

(a) a sled for engaging the ground surface, the front of the sled hingedly attached by a front hinge assembly to the underside of the dirt bucket;

(b) a hydraulic shock absorber comprising a piston end and cylinder end, adapted to be pivotally attached on said piston end to the top surface of the sled back of said front hinge assembly and adapted to be pivotally attached on said cylinder end to the underside of the dirt bucket, said cylinder end possessing an inlet/outlet port for the flow of hydraulic fluid;

(c) a valve package comprising a pressure relief valve, a needle valve and a check valve, such that said valves are fabricated and hydraulically connected within a single valve housing;

(d) a fluid tank providing a reservoir for hydraulic oil, and containing valve means such that a minimum operating pressure may set by introducing hydraulic fluid and inert gas into said fluid tank; and (e) said valve package hydraulically connected between said fluid tank and said inlet/outlet port such that the needle valve and the check valve limit flow of hydraulic fluid from said hydraulic shock absorber to the fluid tank, said pressure relief valve connected such that the maximum pressure in the shock absorber is controlled by the relief setting of the pressure relief valve and a minimum operating pressure is set by introducing an inert gas into said fluid tank.

14. The stabilizing system according to claim 13 wherein the fluid tank is mounted to a rear cross-member of the dirt bucket by a right-side mounting bracket and a left-side mounting bracket.

15. The stabilizing system according to claim 13 wherein a wear plate is affixed to the bottom surface of said sled for making contact with the ground surface.

16. The stabilizing system according to claim 13 wherein the fluid tank has a volume of approximately five gallons.

17. The stabilizing system according to claim 14 wherein said valve package is affixed to said right-hand mounting bracket by fastening means.

18. The stabilizing system according to claim 14 wherein said valve package is affixed to said left-hand mounting bracket by fastening means.

19. The stabilizing system according to claim 13 wherein the fluid tank is equipped with a pop-off valve set to relieve pressure from the fluid tank, said tank being rated for an operating pressure of approximately fifty pounds per square inch.

20. The stabilizing system according to claim 19 wherein the valve package is rated for operating pressure in excess of one thousand five hundred pounds per square inch.

* * * * *